United States Patent [19]

Uchida

[11] Patent Number: 4,852,253

[45] Date of Patent: Aug. 1, 1989

[54] CUTTING DEVICE FOR WRAPPED COIN STACK

[75] Inventor: Shinya Uchida, Chigasaki, Japan

[73] Assignee: Laurel Bank Machines Co., Ltd., Tokyo, Japan

[21] Appl. No.: 210,983

[22] Filed: Jun. 24, 1988

[30] Foreign Application Priority Data

Jul. 2, 1987 [JP] Japan ..... 62-165910
Feb. 19, 1988 [JP] Japan ..... 63-36631

[51] Int. Cl.[4] ..... B67B 7/00
[52] U.S. Cl. ..... 30/2; 30/279.1
[58] Field of Search ..... 30/2, 278, 279 R, 300, 30/310, DIG. 3

[56] References Cited

U.S. PATENT DOCUMENTS 1,959,378 5/1934 Magill ..... 30/2
4,333,234 6/1982 Smith et al. ..... 30/2
4,382,330 5/1983 Harbaugh ..... 30/2 X

FOREIGN PATENT DOCUMENTS 60-154211 10/1985 Japan .

*Primary Examiner*—Douglas D. Watts
*Attorney, Agent, or Firm*—Fleit, Jacobson, Cohn, Price, Holman & Stern

[57] ABSTRACT

A cutting device for a wrapped coin stack comprising cylindrical support member including a bore for receiving one end of a wrapped coin stack bar which is formed by a certain number of coins and wrapped by a wrapping, base plate member for abutting against said one end of the wrapped coin stack bar on its surface, cutter supported by the support member at a position offset from the surface of the base plate member for being advanced inward of the support member and cutting the wrapping.

8 Claims, 5 Drawing Sheets

CUTTING DEVICE FOR WRAPPED COIN STACK

BACKGROUND OF THE INVENTION

1. Field of the invention

The present invention relates to a cutting device for wrapped coin stack, more specifically to a device for cutting a coin wrapping which wraps and holds a coin stack so that the coins of the stack can be taken out of the coin wrapping.

2. Description of the Prior Art

There has been known a coin wrapping which wraps and holds a predetermined number of coins in the form of a stack. In order to take out the coins from the wrapping easily, conventionally, some wrappings have perforations to be torn to thereby take out the coins therefrom, and some wrappings are made of one piece films which can be torn easily.

Japanese Utility Model Public disclosure No. 60-154211, which is laid open to the public on Oct. 15, 1985, discloses an opening device for a wrapped coin stack. According to the disclosure, the opening device is provided with a projection which is applied to a wrapped coin stack bar at the intermediate portion of the stack bar to bend the stack bar and thereby to tear the wrapping. Then the coins in the wrapping or bag are taken out therefrom.

It should however be noted that it is not so easy to tear the wrapping at the perforations and the one piece film of the wrappings resulting in hurting hands.

Even where the wrappings are torn at the intermediate portion thereof as stated in the Japanese Utility Model Public Disclosure No. 60-154211, there often occurs a problem that the coins in the torn wrappings are hard to be taken out therefrom.

In particular, where the bag is made of a paper sheet, the last coin located at the end of the stack is hard to be taken out of the wrapping until the wrapping is torn completely because of a high friction between the paper sheet and the coin.

SUMMARY OF THE INVENTION

It is therefore object of the present invention to solve the above problems in taking out coins from a wrapping which holds a certain number of stacked coins.

It is another object of the present invention to provide a cutting device for a wrapped coin stack which cuts a coin wrapping so that coins stacked in the wrapping can be taken out of the bag readily.

It is further object of the present invention to provide a cutting device for cutting a wrapping of a coin stack wherein the cutting device can be applied to the wrapping in an easy way. It is still further object of the invention to provide a cutting device of a simple structure for cutting a wrapping of a certain number of a coin stack.

According to the present invention, the above and other features of the invention can be accomplished by a cutting device for a wrapped coin stack comprising cylindrical support means including a bore for receiving one end of a wrapped coin stack bar which is formed by a certain number of coins and wrapped by a wrapping means, base plate means for abutting against said one end of the wrapped coin stack bar on its surface, cutting means supported by the support means at a position offset from the surface of the base plate means for being advanced inward of the support means and cutting the wrapping means.

The wrapping means is preferably caulked at the end portions of the coin stack bar.

The cutting means can be constituted by a pair of straight blade means which are pivotally mounted on the support means through suitable connecting means.

The blade means are disposed in slit means formed on the support means and pivotally move about the connecting means so as to be advanced and retracted from the bore of the support means through the slit means. Normally, the cutting means are urged by resilient means to be placed outside of the supporting means. When the cutting means are caused to be advanced inward of the bore of the support means, the wrapping is cut at the end portion which is just outside of an end coin of the coin stack bar. Although the wrapping can be cut off by the cutting means, it can be torn off after being partly cut by the cutter means.

After taking away the end portion of the wrapping, there is formed a free end, namely an opening at the end portion of the wrapping through which the coins in the wrapping can be easily taken out by pushing the other end opposite to the free end of the wrapping.

In another preferred embodiment of the present invention, the blade means is formed on an edge portion of cutter means constituted by a single plate. In this embodiment, the cutting means is slidably disposed in slit means formed on the support means. Normally the cutting means is urged by resilient means to be positioned outside of the cylinder bore of the support means. When the cutting means is moved against a resilient force of the resilient means toward the inside of the cylinder bore of the support means, the blade means is brought into contact with the wrapping to cut it.

The above and other objects and features of the present invention will be apparent from the following description by taking reference with accompanying drawings employed for a preferred of the present invention.

DESCRIPTION OF PREFERRED EMBODIMENTS

Figure 1:
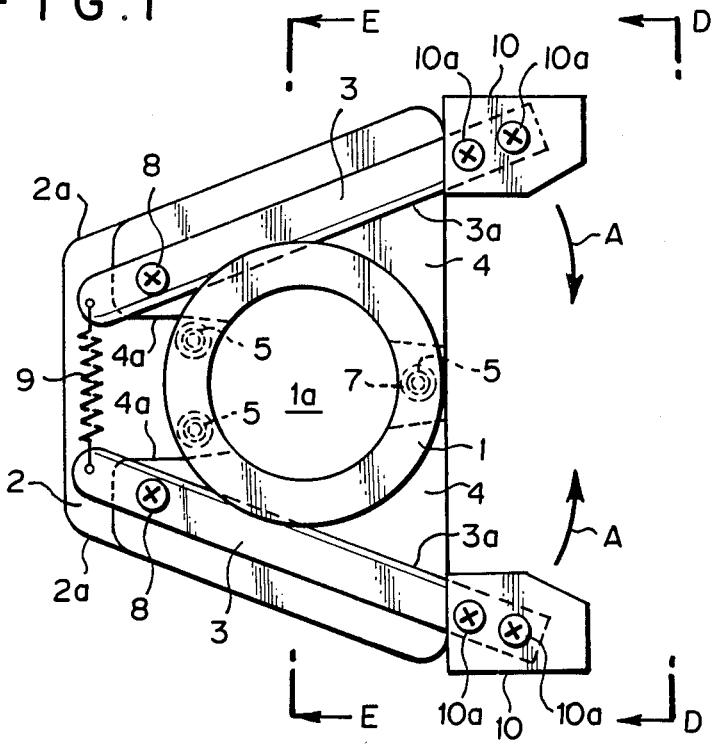
FIG. 1 is a plan view of a cutting device in the normal position of a cutter in accordance with the present invention.

Referring to FIG. 1, there is shown a manual cutting device according to the present invention.

Figure 2:
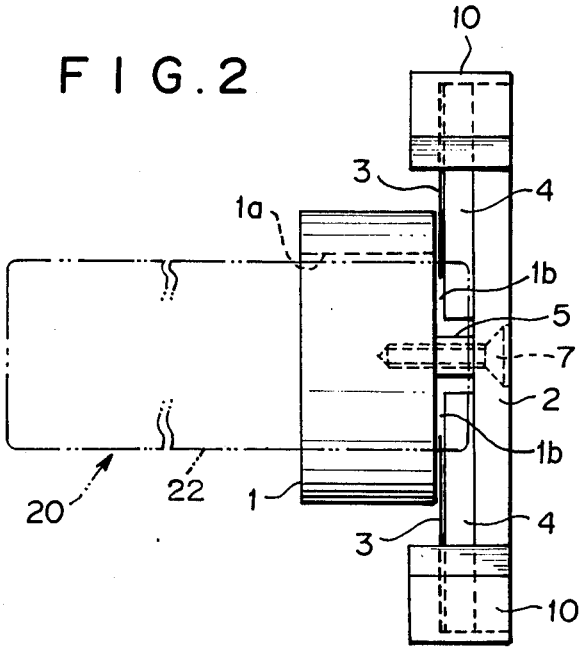
FIG. 2 is a side view of the cutting device in the direction of D—D FIG. 1.

The cutting device includes a cylindrical support member 1, a base plate 2 connected to the support member 1 by three bolt members 7 through tubular spacers 5 so that the base plate 2 is placed at a position spaced from the support member 1, a pair of guide plates 4 disposed between the support member 1 and the base plate 2 at substantially opposite sides of a bore 1*a* of the support member 1 in align with the opposite side edges 2*a* of the base plate 2 of a trapezoidal configuration. The spacer 5 is slightly longer than the thickness of the guide plate 4 in length thereof so that a small space or slit 1*b* is formed between the guide plate 4 and an end surface of the support member 1 as shown in FIG. 2.

A pair of cutters 3 are disposed in the small space 1*b* between the support member 1 and guide plates 4 at the opposite sides of the bore 1*a* so as to slidably move along the slit 1*b*. The cutter 3 is of a long plate and has a blade at one edge facing to the other. Each of the cutter 3 is pivotally mounted on the guide plate 1 at a position close to one end thereof through a bolt 8 which is fixed to the guide plate 4. A coil spring 9 connects resiliently the pair of the cutters 3 at the one ends of the cutters 3 respectively. At the other end of each of the cutter 3 is fixed a grip member 10 by means of bolts 10*a*.

As shown in FIG. 1 the cutters 3 are normally positioned at the opposite sides and outside of the bore 1*a* by the resilient force of the spring 9 so as to extend along the outer edges 2*a* of the base plate 2. This means that a distance between the one ends of the cutters 3 is smaller than that between the other ends of the cutters 3. The cutters 3 are slidably movable in the slit 1*b* from the position shown in FIG. 1 in the direction of arrows A to a position shown in FIG. 4 where inner edges 3*a* of the cutter 3 are substantially aligned with inner edges 4*a* of the guide plates 4 within the bore 1*a* respectively in a manner that the other ends of the cutters 3 are moved to be close to each other. It should be noted that the spacers 5 are disposed within an area formed inside of the inner edges 4*a* of the respective guide plates 4 so as to prevent an interference with the blades of the cutters 3.

In the bore 1*a* of the support member 1, a wrapped coin stack bar 20 is inserted. The coin stack bar 20 is formed by a predetermined number of stacked coins 21. The coin stack bar 20 is wrapped by a wrapping 22 which is caulked at end portions thereof and formed a caulked portion 22*a* for sealing the stacked coins 21.

Figure 3:
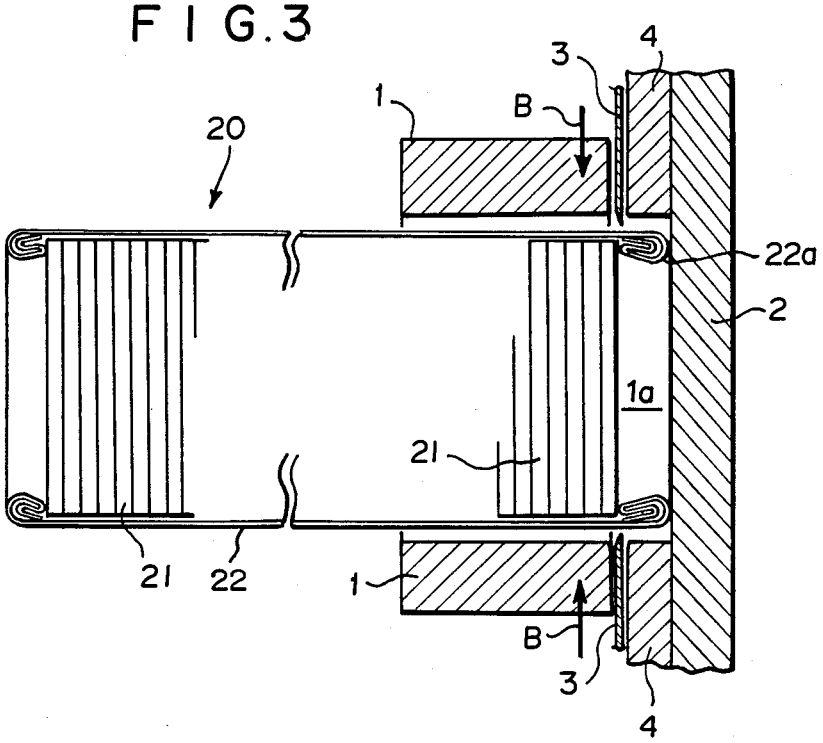
FIG. 3 is a sectional view of the cutting device taken along a line E—E in FIG. 1.
Figure 4:
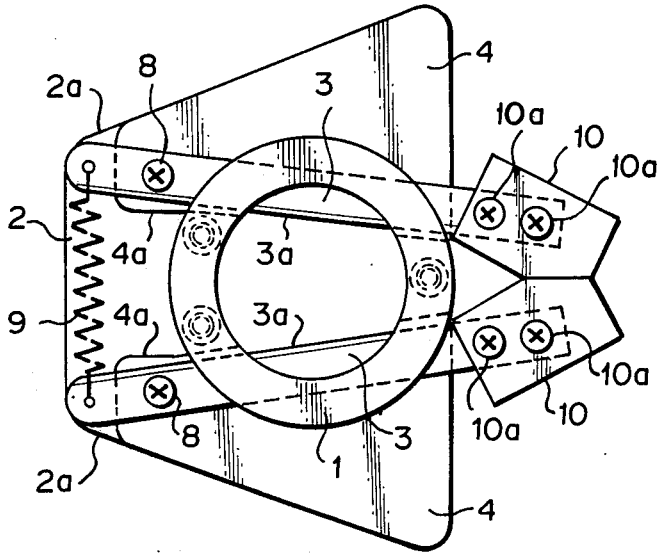
FIG. 4 is a plan view of the cutting device in the operated position of the cutter in accordance with the present invention.

In cutting operation, the wrapped coin stack bar 20 inserted into the bore 1*a* of the support member 1 to abut the tip end portion or the caulked portion 22*a* on the surface of the base plate 2. Then an operator causes the cutters 3 to move to be close to each other as shown arrows B in FIG. 3 so that the blades of the cutters 3 are advanced inward of the bore 1*a* and to a position where the grip members 10 are brought into contact with each other and the cutters 3 extend along the inner edges 4*a* as shown in FIG. 4. During the movement of the cutters 3, the wrapping 22 is brought into contact with the blades of the cutters 3 at the opposite sides and is cut at just outside of an end coin 21. When the caulked portion 22*a* is torn to be separated off from the wrapping 22, the stacked coins 21 held in the wrapping 22 can be taken out thereof easily. Alternatively the caulked portion 22*a* can be cut off from the wrapping 22 by a rotation of the cutting device with the position of FIG. 4.

Figure 5:
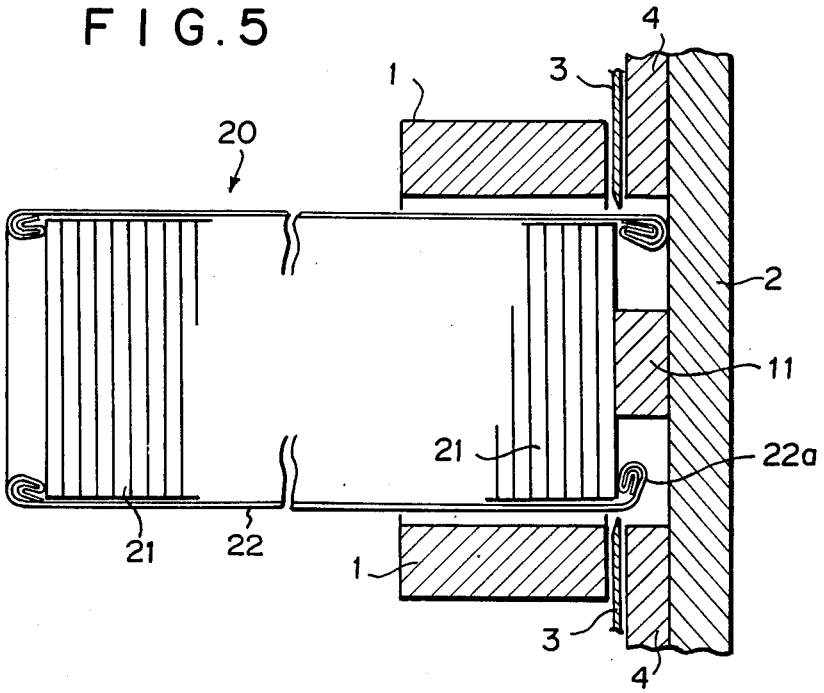
FIG. 5 is a sectional view of a cutting device in accordance with a further embodiment of the present invention.
Figure 6:
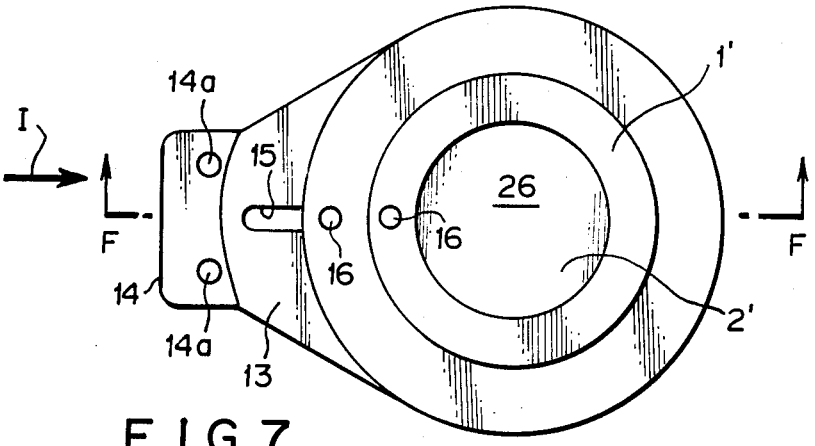
FIG. 6 is a plan view of a cutting device in accordance with a embodiment of the present invention.

There is shown another embodiment of the present invention in FIG. 5. In this embodiment, there is provided a center guide 11 attached on the base plate 2. The center guide 11 is projected toward the end surface of the coin stack bar 20 and can be brought into contact with the surface in the case where the caulked portion 22*a* of the wrapping 22 is intensely caulked or deformed. Therefore, the cutting device according to this embodiment can cut the caulked portion 22*a* properly irrespective of the thickness of the caulked portion 22*a*.

There is shown a further embodiment of the present invention in FIGS. 6 through 11.

In this embodiment, a cylindrical support portion 1′ and base plate portion 2′ is integrally constituted by a single member 25. The member 25 has a cylindrical recess 26 therein.

Figure 7:
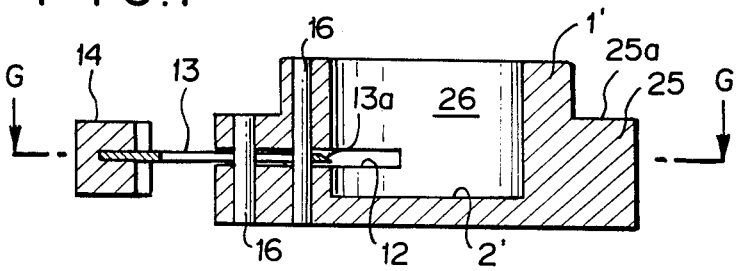
FIG. 7 is a sectional view of the cutting device of FIG. 6 taken line F—F.
Figure 8:
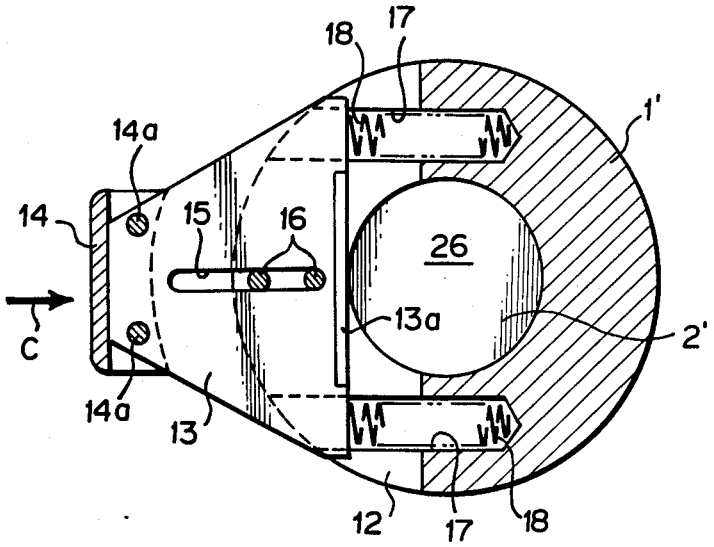
FIG. 8 is a sectional view of the cutting device of FIG. 7 taken a G—G.
Figure 9:
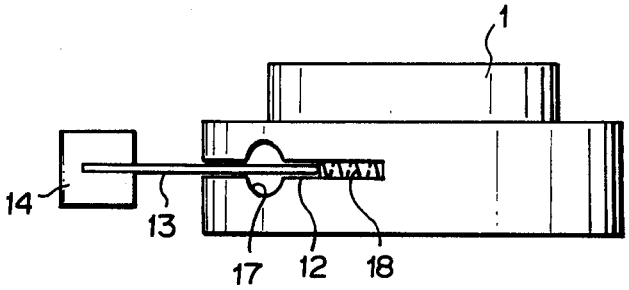
FIG. 9 is a side s view of the cutting device seen in the direction of arrow I in FIG. 6.
Figure 10:
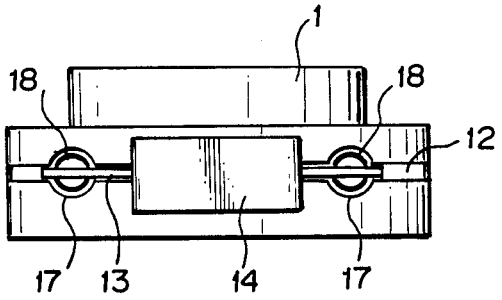
FIG. 10 is a side view of the cutting device seen in the direction of arrow I in FIG. 6.
Figure 11:
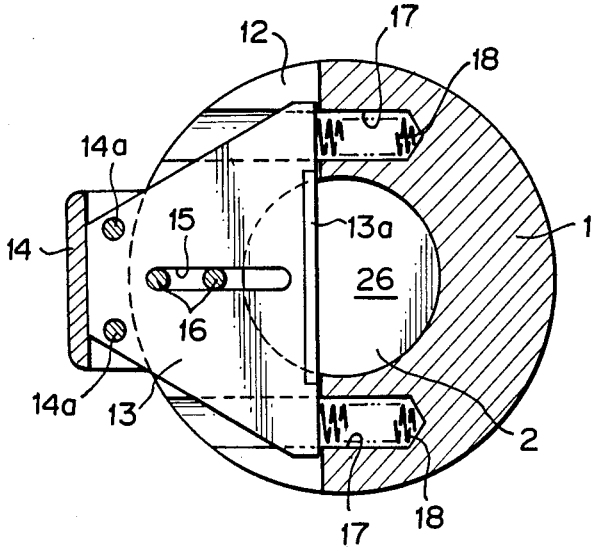
FIG. 11 is a sectional view similar to FIG. 8 but in the operated position of the cutter.

The base plate portion 2′ is bigger than the support member 1′ in outer diameter so that a stepped portion or shoulder portion 25*a* is formed as shown in FIG. 7. The member 25 is formed with a slit 12 which is apart from a bottom surface of the recess or bore 26 of the member 25 by a certain distance. The slit 12 is extended in parallel with the bottom surface and terminated in the recess 26. A plate or cutter 13 of a trapezoidal configuration is slidably disposed in the slit 12 formed on the member 25. The cutter 13 is formed with a blade 13*a* at the front edge portion. The cutter 13 is provided with a grip member 14 which is fixed to the rear end of the cutter 13 by means of a pair of bolts 14*a*. The grip member 14 is brought into contact with the outer surface of the base plate portion 2′ to stop the cutter 13 when the cutter 13 is advanced toward the bore 26. A pair of springs 18 are disposed in a pair of holes 17 formed on the member 25 at the opposite end portions of the cutter 13 to urge the cutter outward of the bore 26. A pair of stopper pins 16 are placed side by side in the moving direction of the cutter 13. The stopper pins 16 are received in an elongated opening 15 formed on the cutter 13 which opening 15 is extended in the moving direction of the cutter 13. Normally, the cutter 13 is urged by the springs 18 to be positioned outside of the bore 26. When the grip member 14 is pushed toward the bore 26 as shown in FIG. 8 by arrow C against the resilient force of the pair of springs 18, the cutter 13 is advanced inward of the bore 26 along the opening 15 until the rear edge of the opening 15 is abutted against the rear stopper pin 16. During this movement, the blade 13*a* of the cutter 13 is brought into contact with the wrapping 22 of the coin stack bar 20 to cut the wrapping 22 at the caulked portion 22*a* as shown in FIG. 11. Thereafter the caulked portion 22*a* can be separated away from the wrapping 22 to open it so that the coins 21 in the wrapping can be easily and quickly taken out in the same manner as the former embodiment of the invention.

In the case where the cutting device is rotated with the position shown in FIG. 11, the caulked portion 22*a* can be separated without any tearing work therefor.

The cutter 13 can be driven automatically by employing an electrical mechanism such as a solenoid device.

It will be apparent from the above description that many modifications and variations may be made by those skilled in the art without apart from the scope of the claimed invention as attached.

I claim:

1. A cutting device for a wrapped coin stack comprising:

cylindrical support means including a bore for receiving one end of a wrapped coin stack bar which is formed by a certain number of coins and wrapped by wrapping means, base plate means for abutting against said one end of the wrapped coin stack bar on its surface, said base plate means being connected to said cylindrical support means by a plurality of bolt members through tubular spacers so that the base plate means is placed at a position spaced from the cylindrical support means, and cutting means supported by the cylindrical support means at a position offset from the surface of said base plate means for being advanced inward of the cylindrical support means and cutting the wrapping means.

2. A cutting device for a wrapped coin stack comprising:

cylindrical support means including a bore for receiving one end of a wrapped coin stack bar which is formed by a certain number of coins and wrapped by wrapping means, base plate means for abutting against said one end of the wrapped coin stack bar on its surface, said base plate means being of a trapezoidal configuration, cutting means supported by the cylindrical support means at a position offset from the surface of said base plate means for being advanced inward of the cylindrical support means and cutting the wrapping means, and a pair of guide plate means being disposed between the cylindrical support means and the base plate means substantially opposite sides of the bore of the cylindrical support means in alignment with the opposite edges of the base plate means.

3. A cutting device in accordance with claim 2, wherein said base plate means is connected to the cylindrical support means by a plurality of bolt members through tubular spacers so that the base plate means is placed at a position spaced from the cylindrical support means and said tubular spacers are slightly longer than the thickness of the guide plate means in length thereof so that slit means is formed between the guide plate means and an end surface of the cylindrical support means.

4. A cutting device for a wrapped coin stack comprising:

cylindrical support means including a bore for receiving one end of a wrapped coin stack bar which is formed by a certain number of coins and wrapped by wrapping means, base plate means for abutting against said one end of the wrapped coin stack bar on its surface, cutting means supported by the cylindrical support means at a position offset from the surface of said base plate means for being advanced inward of the cylindrical support means and cutting the wrapping means, said cutting means being constituted by a pair of straight blade means which are pivotally mounted on the cylindrical support means through connecting means, a coil spring for connecting resiliently the pair of blade means at one end of the respective blade means, and grip means fixed to the other ends of the respective blade means.

5. A cutting device in accordance with claim 4, wherein guide plate means are disposed between the cylindrical support means and the base plate means substantially opposite sides of the bore of the cylindrical support means in alignment with the opposite side edges of the base plate means and slit means is formed between the guide plate means and an end surface of the cylindrical support means and the cutting means are normally urged by resilient means to be placed outside of the cylindrical support means and are slidably movable in the slit means from the normal position to a position where inner edges of the cutting means are substantially aligned with inner edges of the guide plate means respectively in such a manner that the other ends of the respective blade means are moved to be close to each other.

6. A cutting device in accordance with claim 2, wherein the base plate means is connected to the cylindrical support means by a plurality of bolt members through tubular spacers so that the base plate means is placed at a position spaced from said cylindrical support means, said tubular spacers being disposed within an area formed inside of inner edges of the respective guide plate means so as to prevent an interference with the cutting means.

7. A cutting device for a wrapped coin stack comprising:

cylindrical support means including a bore for receiving one end of a wrapped coin stack bar which is formed by a certain number of coins and wrapped by wrapping means, base plate means for abutting against said one end of the wrapped coin stack bar on its surface, cutting means supported by the cylindrical support means at a position offset from the surface of said base plate means for being advanced inward of the cylindrical support means and cutting the wrapping means, said cutting means being formed by a trapezoidal plate, and a pair of spring means disposed in a pair of holes formed on the base plate means at the opposite end portions of the cutting means for urging the cutting means outward of the bore.

8. A cutting device in accordance with claim 7, wherein a pair of stopper means are placed side by side in the moving direction of the cutting means, said stopper means being received in an elongated opening formed on the cutting means, the opening being extended in the moving direction of the cutting means.

* * * * *